US006981527B2

(12) United States Patent
Froment

(10) Patent No.: US 6,981,527 B2
(45) Date of Patent: Jan. 3, 2006

(54) HEDDLE, HEDDLE FRAME AND WEAVING LOOM EQUIPPED WITH SUCH A FRAME

(75) Inventor: Jean-Paul Froment, Doussard (FR)

(73) Assignee: Staubli Faverges, Faverges (FR)

( * ) Notice: Subject to any disclaimer, the term of this patent is extended or adjusted under 35 U.S.C. 154(b) by 201 days.

(21) Appl. No.: 10/742,923

(22) Filed: Dec. 23, 2003

(65) Prior Publication Data

US 2004/0154681 A1 Aug. 12, 2004

(30) Foreign Application Priority Data

Dec. 24, 2002 (FR) ..... 02 16661

(51) Int. Cl.
*D03C 9/00* (2006.01)

(52) U.S. Cl. ..... 139/93; 139/94; 139/96

(58) Field of Classification Search ..... 139/93, 139/92, 94, 96

See application file for complete search history.

(56) References Cited

U.S. PATENT DOCUMENTS

| | | | | |
|---|---|---|---|---|
| 887,102 | A * | 5/1908 | Lackey | 139/96 |
| 2,426,546 | A * | 8/1947 | Kaufmann | 139/92 |
| 2,461,497 | A | 2/1949 | Kaufmann | |
| 2,552,487 | A * | 5/1951 | Kaufmann | 139/96 |
| 2,840,114 | A * | 6/1958 | Sides | 139/96 |
| 3,548,885 | A * | 12/1970 | Wagner | 139/96 |
| 3,590,880 | A * | 7/1971 | Kathriner | 139/192 |
| 4,519,424 | A | 5/1985 | Ishido et al. | |
| 4,790,357 | A * | 12/1988 | Kramer | 139/91 |
| 5,176,183 | A * | 1/1993 | Koch | 139/93 |
| 5,309,951 | A * | 5/1994 | Steiner | 139/368 |
| 6,009,918 | A | 1/2000 | Beyaert | |
| 6,176,270 | B1 * | 1/2001 | Mettler | 139/93 |
| 6,230,756 | B1 * | 5/2001 | Baumann et al. | 139/93 |

FOREIGN PATENT DOCUMENTS

| | | |
|---|---|---|
| CH | 155094 | 11/1932 |
| DE | 1535847 | 7/1970 |
| EP | 0302798 | 2/1989 |
| FR | 2214779 | 1/1974 |

* cited by examiner

*Primary Examiner*—John J. Calvert
*Assistant Examiner*—Robert H. Muromoto
(74) *Attorney, Agent, or Firm*—Dowell & Dowell, P.C.

(57) ABSTRACT

The heddle according to the invention is provided at the level of each of its ends with at least two sections for simultaneous bearing on corresponding surfaces formed on a traction bar fast with a crossbeam of a heddle frame. These sections and surfaces allow the transmission of an effort of traction exerted by one of the crossbeams on the heddle. They are offset in a direction substantially parallel to a longitudinal axis of the heddle and to an axis of the uprights of the frame.

17 Claims, 2 Drawing Sheets

HEDDLE, HEDDLE FRAME AND WEAVING LOOM EQUIPPED WITH SUCH A FRAME

FIELD OF THE INVENTION

The present invention relates to a heddle, to a heddle frame and to a weaving loom equipped with such a frame.

BACKGROUND OF THE INVENTION

It is known to equip a weaving loom with heddle frames intended to be controlled in a vertical oscillatory movement thanks to an appropriate device, such as a heald system or a dobby. It is known to mount on these frames heddles each provided with an eye for passage of warp yarn of the loom. The assembly between the heddles and the hooking bars of the crossbeams of a heddle frame may take various forms, as indicated in CH-A-155094, EP-A-0302798, FR-A-2 214 770 and U.S. Pat. No. 2,461,497. In the latter document, it is provided that an anti-rotation bar distinct from the crossbeams of the frame traverses the heddles supported by the latter. U.S. Pat. No. 4,519,424 teaches introducing the ends of a heddle in openings provided in the upper and lower beam members of a frame. An anti-rotation devices of the heddles may be used. As for DE-A-15 35 847, it discloses various end geometries of heddles. In the known devices, the effort of traction exerted by the frame to drive the heddles transits via contact surfaces of small total area.

Taking into account the manufacturing tolerances of this equipment and their possible deformations under the effect of the loads and violent accelerations to which they are subjected, a functional clearance of the order of 3 mm is generally provided between crossbeams of the frames and the ends of the heddles. Whenever the movement of the frames is reversed, a shock is therefore produced between each heddle and the bars of the crossbeams on which it is hooked in the upper and lower part, this resulting in a premature beating and wear of their respective contact surfaces. Now, taking into account the usual operating conditions of weaving looms in a damp atmosphere, the heddles and bars must be made of stainless materials of which the hardness is limited, while the treatments for increasing this hardness are expensive. Furthermore, the width of the surfaces for contact and for transmission of traction effort between the crossbeams and the heddles cannot be increased in view of the width of division of the frames and the density of the heddles over the width of the loom. The known heddles and hooking parts of the crossbeams of the heddle frames thus tend to wear out rapidly and this results in an increase in the clearance and breakages of heddles. Preventive maintenance operations should therefore be regularly carried out, this leading to the weaving looms concerned being repeatedly immobilized.

It is a more particular object of the present invention to overcome these drawbacks by proposing a novel system for hooking the heddles on the crossbeams of the corresponding frames, which makes it possible to limit the wear induced by the vertical oscillatory movements of this equipment.

SUMMARY OF THE INVENTION

In this spirit, the invention relates to a heddle for a weaving loom equipped with at least one heddle frame comprising two crossbeams on each of which this heddle is intended to be hooked by its ends. This heddle is characterized in that it is provided, at each end, with at least two sections for simultaneous bearing on at least two corresponding surfaces formed on a traction bar fast with one of the crossbeams, these sections being adapted to transmit a traction effort exerted by one of the crossbeams on the heddle, while these sections are offset in a direction substantially parallel to a longitudinal axis of the heddle.

Thanks to the correct positioning of the bearing and effort transmission sections of the heddle, there is obtained an increase of the contact surfaces of the heddle with the corresponding part of the crossbeams, in particular a hooking bar, which makes it possible to reduce the contact pressure at the level of the zone of bearing of the heddle on the crossbeam without increasing the thickness of the heddle or its space requirement in the direction of the division. This allows a reduction of the beating of these parts and consequently of the wear by abrasion at that level, when a traction effort is transmitted from one of the crossbeams towards the heddle in accordance with the invention. Taking into account this multiplication of the contact and traction effort transmission surfaces, it is not indispensable to use a material with high mechanical characteristics for making the heddles and/or the hooking bars, this allowing savings to be made in the manufacture of this equipment.

According to advantageous but non-obligatory aspects of the invention, this heddle incorporates one or more of the following characteristics:

- the part for hooking the heddle on a crossbeam comprises two branches defining therebetween a volume for receiving the bar of the crossbeam. At least one of these branches is advantageously provided with at least two teeth each defining one of the afore-mentioned bearing sections. In a variant, each branch is provided with at least one tooth oriented towards the other branch and defining a bearing section. In that case, at least certain of the teeth provided on each of these branches may be disposed opposite one another or in quincunx.
- the bearing sections provided on the heddles may be provided to be substantially perpendicular or, for at least one of them, oblique with respect to the longitudinal axis of the heddle.
- the hooking part of the heddle is substantially in the form of a C or a closed loop, with a section adapted to cover a corresponding part of the crossbeam and at least one intermediate tooth projecting in the direction of the centre of this hooking part and forming a bearing section.

The invention also relates to a heddle frame adapted to cooperate with a heddle as described hereinabove and, more specifically, to a heddle frame comprising two uprights and two crossbeams equipped with bars on which heddles may be hooked, characterized in that each bar is provided with at least two surfaces for simultaneous bearing for corresponding sections of the heddles, these surfaces being adapted to transmit an effort of traction exerted by the bar on a heddle, while they are offset in a direction substantially parallel to a longitudinal axis of one of the afore-mentioned uprights.

According to an advantageous aspect of the invention, these bearing surfaces are regularly distributed on either side of a median plane of the bar. In a variant, it is possible that these surfaces are not symmetrical with respect to this median plane.

Depending on the forms of embodiment envisaged, the bearing surfaces may be substantially perpendicular to the axis of the upright or, for at least one of them, oblique with respect thereto.

The invention also relates to a heddle frame as mentioned hereinabove equipped with heddles as described previously.

Finally, the invention relates to a weaving loom equipped with at least one heddle frame as described previously. Such a loom has higher performances, it is more reliable and more economical to operate than those of the prior art.

BRIEF DESCRIPTION OF THE DRAWINGS

The invention will be more readily understood on reading the following description of a weaving loom, heddle frames and heddles in accordance with its principle, given solely by way of example and made with reference to the accompanying drawings, in which.

DESCRIPTION OF PREFERRED EMBODIMENTS

Figure 1:
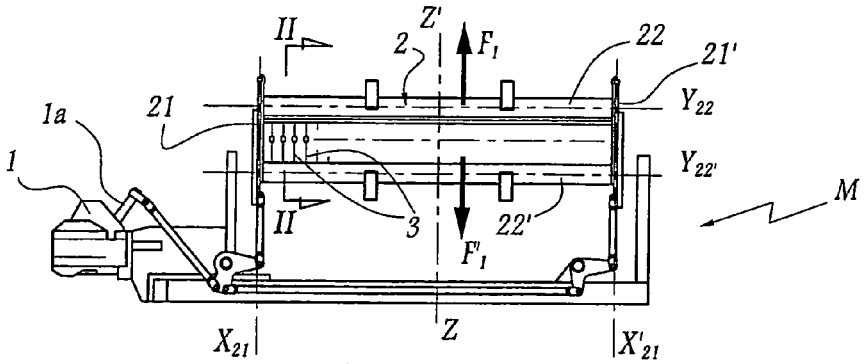
FIG. 1 schematically shows a weaving loom according to the invention.

Referring now to the drawings, and firstly to FIG. 1, a dobby 1 is intended to drive a heddle frame 2 of a weaving loom M in a vertical oscillating movement represented by arrows $F_1$ and $F'_1$. To that end, an arm 1*a* for actuating the dobby 1 is coupled by connecting rods and rocking levers to the frame 2. The loom M comprises a plurality of frames, generally between 6 and 24, only one of these frames being shown in FIG. 1 in order to render the drawing clearer.

Each frame 2 is formed by the assembly of two uprights 21 and 21' and of two crossbeams 22 and 22'. The respective longitudinal axes $X_{21}$ and $X_{21'}$ of the uprights 21 and 21' are substantially parallel to the direction Z–Z' of vertical oscillations of the frame 2, while the crossbeams 22 and 22' extend substantially in two directions $Y_{22}$ and $Y_{22'}$ perpendicular to direction Z–Z' and to the warp yarns of the loom, directions $Y_{22}$ and $Y_{22}'$ being in practice horizontal when the loom is in configuration of use.

Figure 2:
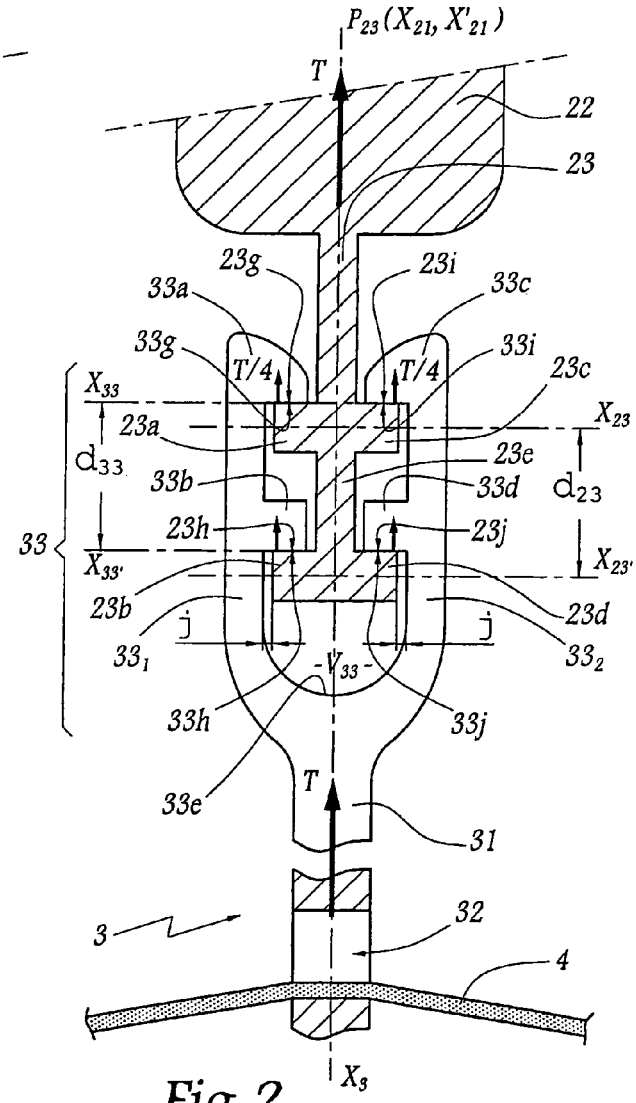
FIG. 2 is a partial section along line II—II of FIG. 1.

The upper crossbeam 22 is equipped with a bar 23 on which the heddles 3 are hooked. The bar 23 is symmetrical with respect to a median plane $P_{23}$ parallel to the directions $Y_{22}$ and Z–Z'. In the plane of FIG. 2, the trace of the plane $P_{23}$ merges with axis Z–Z'.

The bar 23 extends over substantially the whole length of the crossbeam 22 and is provided with four lateral ribs 23*a*, 23*b*, 23*c* and 23*d* which extend, from a median part 23*e*, in two directions $X_{23}$ and $X_{23'}$ perpendicular to the plane $P_{23}$.

The respective upper surfaces of the ribs 23*a* to 23*d*, which surfaces are denoted 23*g*, 23*h*, 23*i* and 23*j*, are also perpendicular to the plane $P_{23}$ and therefore to the direction Z–Z' and to axes $X_{21}$ and $X_{21'}$. The surfaces 23*g* and 23*i* are offset with respect to surfaces 23*h* and 23*i* in the direction of axes $X_{21}$ and $X_{21'}$.

The heddle 3 shown in FIG. 2 comprises an elongated element 31 which extends in the direction Z–Z' and which is provided with an eye 32 for passage of a warp yarn 4.

The upper end 33 of the heddle 3 is provided for hooking on the bar 23 and comprises two branches $\mathbf{33}_1$ and $\mathbf{33}_2$ defining therebetween a volume $V_{33}$ for receiving the bar 23.

The branch $\mathbf{33}_1$ is provided with two teeth 33*a* and 33*b* oriented towards the arm $\mathbf{33}_2$. In the same way, the branch $\mathbf{33}_2$ is provided with two teeth 33*c* and 33*d* oriented towards the branch $\mathbf{33}_1$. The teeth 33*a* and 33*c* are opposite each other, in the same way as teeth 33*b* and 33*d* are.

33*g*, 33*h*, 33*i* and 33*j* respectively denote the edges of the teeth 33*a* to 33*d* towards the bottom 33*e* of the volume $V_{33}$.

$X_3$ denotes the longitudinal axis of the heddle 3, this axis being included in the plane $P_{23}$ and merges with the direction Z–Z' in the representation of FIG. 2.

The edges 33*g* to 33*j* are perpendicular to axis $X_3$ and offset in twos therealong, since they extend in two directions $X_{33}$ and $X_{33'}$ which are perpendicular to this axis and offset, like directions $X_{23}$ and $X_{23'}$.

The distance $d_{23}$ between the directions $X_{23}$ and $X_{23'}$ is substantially the same as the distance $d_{33}$ between directions $X_{33}$ and $X_{33'}$.

In this way, when the heddle 3 is hooked on the bar 23 of the crossbeam 22, the edges 33*g* to 33*j* form four sections for bearing on the corresponding surfaces 23*g* to 23*i* of this bar, these sections and these surfaces being parallel to one another, perpendicular to axes $X_{21}$, $X_{21'}$ and $X_3$ and offset along these axes. Two sets of sections and surfaces 23*g*, 23*i*, 33*g* and 33*i* are located at a first level, while the other sections and surfaces 23*h*, 33*h*, 23*j* and 33*j* are located at another level.

Thanks to this distribution of the zones of contact between the heddle 3 and the bar 23, the contact pressure in each of the bearing zones is decreased with respect to the known systems, this making it possible to reduce the risks of beating and wear by abrasion of the parts 23 and 33.

In particular, when an effort of upward traction T is exerted by the crossbeam 22 on the heddle 3, this effort is distributed fairly regularly between the couples of sections and of surfaces 23*g*/33*g*, 23*i*/33*i*, 23*h*/33*h* and 23*j*/33*j*. The effort transmitted at the level of each of these couples has an intensity T/4 equal to about a quarter of that of effort T.

It will be noted that a lateral clearance i is possible between the ribs 23*a* to 23*d* and the branches $\mathbf{33}_1$ and $\mathbf{33}_2$ without negative influence on the reliability of the hooking, as a lateral displacement of the heddle 3 with respect to the bar 23 results in a simple change in distribution of the bearings between the branches $\mathbf{33}_i$ and $\mathbf{33}_2$, the useful bearing surface remaining substantially the same. The clearance i allows an angular clearance of the heddle 3 about its axis $X_3$.

An arrangement of the same type is provided for hooking the lower end of the heddle 3 on the bar of the crossbeam 22'.

Figure 3:
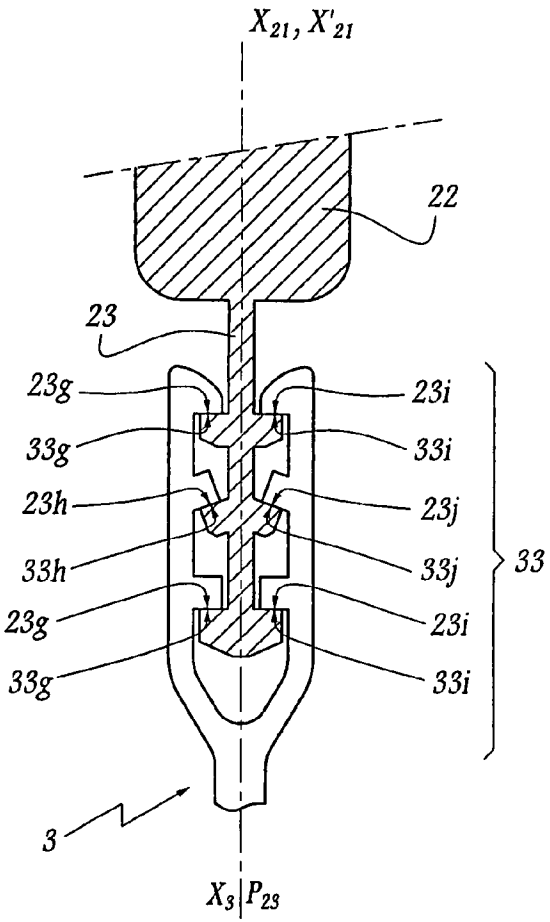
FIG. 3 is a section similar to FIG. 2 but on a smaller scale, for a frame and a heddle according to a second form of embodiment of the invention.

As shown in FIG. 3, the ribs of the bar 23 of a crossbeam 22 may be six in number and distributed over three levels, extending on either side of a median plane $P_{23}$ of the bar 23 and having their upper surface perpendicular to this plane and to the longitudinal axes of the upright of the frame in question. The branches of the hooking part 33 of a heddle 3 are in that case each provided with three teeth, of which the lower edges are perpendicular to the longitudinal axis $X_3$ of the heddle and are provided to form sections for bearing on the upper surfaces of the ribs.

The intermediate bearing sections 33*h* and 33*j* are oblique with respect to axis $X_3$. The corresponding bearing surfaces 23*h* and 23*i* are likewise oblique, with the same angle of obliqueness with respect to the median plane $P_{23}$ of the bar 23. In practice, the number and position of the couples constituted by oblique sections/bearing surfaces result from a choice of design.

Figure 4:
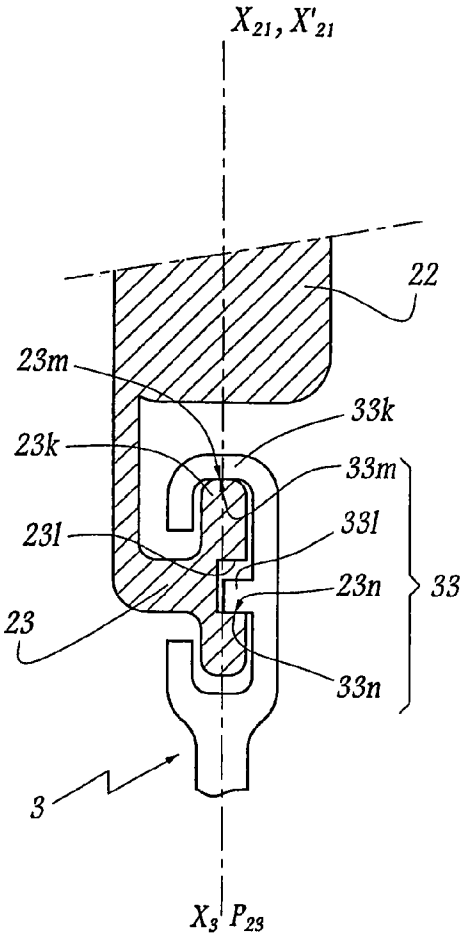
FIG. 4 is a section similar to FIG. 3 for a frame and a heddle according to a third embodiment of the invention.

As shown in FIG. 4, the bar 23 of a crossbeam 22 may be asymmetrical, the hooking part 33 of a heddle 3 in that case being substantially in the form of a C with a first section 33*k* provided to cover a corresponding part 23*k* of the bar 23. The part 33 is also provided with an intermediate tooth 33*l* which projects in the direction of the centre of part 33, i.e. in particular of the axis $X_3$ of the heddle 3 in question, and which is intended to penetrate in a longitudinal groove 23*l* of the bar 23.

23*m* denotes the upper surface of the part 23*k* and 23*n* the lower surface of the groove 23*l*. Furthermore, 33*m* denotes the lower edge of the section 33*k* and 33*n* the lower edge of the tooth 33*l*.

It will be understood that the edges 33*m* and 33*l* constitute sections bearing on the surfaces 23*m* and 23*n*, these sections and these surfaces being offset along the axis $X_3$ which is parallel to axes $X_{21}$ and $X_{21'}$ of the uprights of the frame in question, these edges and these surfaces being perpendicular to the axes in question.

Figure 5:
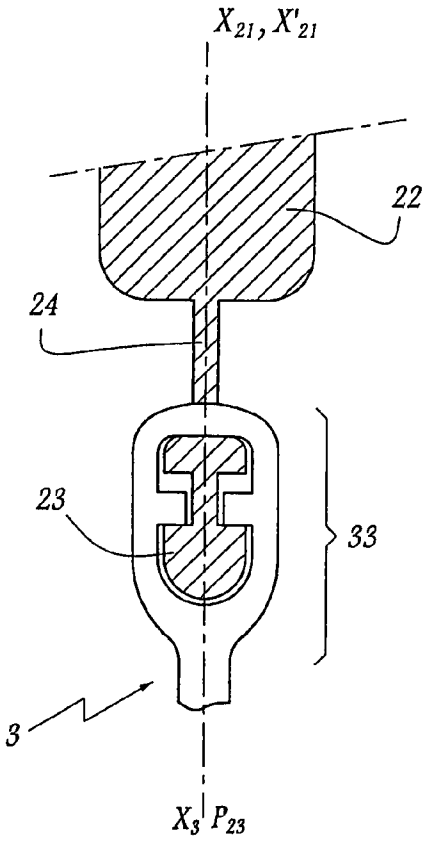
FIG. 5 is a section similar to FIG. 3 for a frame and a heddle according to a fourth embodiment of the invention.

As is visible in FIG. 5, it is also possible for the hooking part 33 of a heddle 3 to be in the form of a closed loop with an upper section intended to cover a bar 23 which is suspended from the principal part of the crossbeam 22 by tongues 24 distributed over its length. Part 33 is provided with two internal teeth intended to penetrate in longitudinal grooves in part 23, like tooth 33*l* of the embodiment of FIG. 4. As previously, bearing sections and surfaces are provided which are offset with respect to the longitudinal axis $X_3$ of the heddle and to the longitudinal axes $X_{21}$ and $X_{21'}$ of the uprights of the frame, these sections and these surfaces being substantially perpendicular to these axes.

According to a very advantageous aspect of the invention, which is independent of the form of embodiment chosen, the lower parts of the heddles have substantially the same geometry as the upper parts and the crossbeam 22' is equipped with a bar similar to the bar 23 described hereinabove, this making it possible to have a hooking of the same nature in the lower part of the heddles.

In the forms of embodiment of FIGS. 4 and 5, a plurality of intermediate teeth may be provided.

Figure 6:
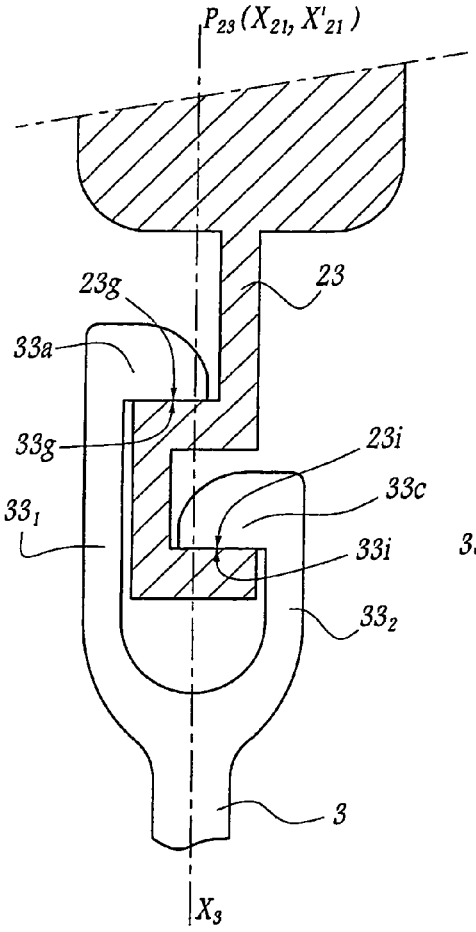
FIG. 6 is a section similar to FIG. 3 for a frame and a heddle according to a fifth embodiment of the invention.

As shown in FIG. 6, the teeth 33*a* and 33*c* provided on the branches $\mathbf{33}_1$ and $\mathbf{33}_2$ of a heddle 3 may be in quincunx with respect to each other. In that case, the bearing sections 33*g* and 33*l* formed by these teeth are likewise in quincunx, like the bearings surfaces 23*g* and 23*i* formed by the bar 23 of the crossbeam in question.

In the embodiments of FIGS. 3 to 6, the sections and surfaces offset in parallel to the axes of the heddles and the uprights of the frames also serve to transmit an effort of traction from the crossbeams towards the heddles, of the type of effort T mentioned with reference to the first embodiment.

The embodiments of FIGS. 2 to 4, 5 and 6 present the advantage that the hooking zones of the heddles are of open type, this allowing easy dismantling and re-assembly, particularly for maintenance operations.

The technical characteristics of the different forms of embodiment described may be combined within the framework of the present invention.

What is claimed is:

1. Heddle for a weaving loom equipped with at least one heddle frame comprising two crossbeams on each of which said heddle is intended to be hooked, wherein said heddle is provided, at each end, with at least two sections for simultaneous bearing on at least two of the corresponding surfaces formed on a traction bar fast with one of said crossbeams, said sections being adapted to transmit a traction effort exerted by one of said crossbeams on said heddle and offset in a direction substantially parallel to a longitudinal axis of said heddle.

2. The heddle of claim 1, wherein the part of said heddle for hooking on a crossbeam comprises two branches defining therebetween a volume for receiving said bar.

3. The heddle of claim 2, wherein each branch is provided with at least one tooth oriented towards the other branch and defining one of said bearing sections.

4. The heddle of claim 2, wherein at least one of said branches is provided with at least two teeth oriented towards the other branch and each defining one of said bearing sections.

5. The heddle of claim 3, wherein said teeth provided on at least certain of said branches are disposed opposite one another.

6. The heddle of claim 3, wherein at least certain of said teeth provided on said branches are in quincunx.

7. The heddle of claim 1, wherein the hooking part of said heddle is substantially in the form of a C or a closed loop with a section adapted to cover a corresponding part of the crossbeam and at least one intermediate tooth projecting in the direction of the centre of said part and forming a bearing section.

8. The heddle of claim 1, wherein said bearing sections are substantially perpendicular to said longitudinal axis of the heddle.

9. The heddle of claim 1, wherein at least one of said sections is oblique with respect to said longitudinal axis.

10. Heddle frame for weaving loom, said frame comprising two uprights and two crossbeams equipped with bars on which heddles may be hooked, wherein each bar is provided with at least two surfaces for simultaneous bearing for corresponding sections of the heddles, said surfaces being adapted to transmit an effort of traction exerted by said bar on a heddle and offset in a direction substantially parallel to a longitudinal axis of one of said uprights.

11. The frame of claim 10, wherein said bearing surfaces are regularly distributed on either side of a median plane of said bar.

12. The frame of claim 10, wherein said bearing surfaces are not symmetrical with respect to a median plane of said bar.

13. The frame of claim 10, wherein said bearing surfaces are substantially perpendicular to said axis of one of said uprights.

14. The frame of claim 10, wherein at least one of said bearing surfaces is oblique with respect to said axis of one of said uprights.

15. Weaving loom equipped with at least one heddle frame according to claim 10.

16. Heddle frame for weaving loom, said frame comprising two uprights and two crossbeams equipped with bars on which heddles may be hooked, wherein each bar is provided with at least two surfaces for simultaneous bearing for corresponding sections of the heddles, said surfaces being adapted to transmit an effort of traction exerted by said bar on a heddle and offset in a direction substantially parallel to a longitudinal axis of one of said uprights, said frame being equipped with heddles according to claim 1.

17. Weaving loom equipped with at least one heddle frame according to claim 16.

* * * * *